US008220162B2

(12) United States Patent
Rayner

(10) Patent No.: US 8,220,162 B2
(45) Date of Patent: Jul. 17, 2012

(54) CUTTER DEVICE

(75) Inventor: William Rayner, Neutral Bay (AU)

(73) Assignee: Rayner Design Pty Ltd (AU)

( * ) Notice: Subject to any disclaimer, the term of this patent is extended or adjusted under 35 U.S.C. 154(b) by 412 days.

(21) Appl. No.: 12/309,937

(22) PCT Filed: Jul. 31, 2007

(86) PCT No.: PCT/AU2007/001065

§ 371 (c)(1),
(2), (4) Date: Feb. 2, 2009

(87) PCT Pub. No.: WO2008/014546

PCT Pub. Date: Feb. 7, 2008

(65) Prior Publication Data

US 2009/0320664 A1 Dec. 31, 2009

(30) Foreign Application Priority Data

Aug. 2, 2006 (AU) ..... 2006904172

(51) Int. Cl.
*B26B 25/00* (2006.01)

(52) U.S. Cl. ..... 30/240; 30/280; 30/292; 30/314

(58) Field of Classification Search ..... 30/314, 30/280, 294, 240, 319, 292
See application file for complete search history.

(56) References Cited

U.S. PATENT DOCUMENTS

| | | | | | |
|---|---|---|---|---|---|
| 1,268,997 | A | * | 6/1918 | Pruett | 30/294 |
| 1,642,625 | A | * | 9/1927 | Norton | 452/134 |
| 1,649,957 | A | | 11/1927 | Holtzman | |
| 2,073,855 | A | * | 3/1937 | Steinmetz | 30/294 |
| 2,357,379 | A | * | 9/1944 | Bradley | 30/294 |
| 2,966,742 | A | * | 1/1961 | Harian | 30/314 |
| 3,189,997 | A | | 6/1965 | Mount | |
| 3,443,314 | A | | 5/1969 | Leopold et al. | |
| 3,448,519 | A | * | 6/1969 | Tobias | 30/293 |
| 3,486,228 | A | * | 12/1969 | James | 30/294 |
| 3,710,445 | A | | 1/1973 | Roth | |
| 3,831,274 | A | * | 8/1974 | Horrocks | 30/90.4 |
| 5,860,217 | A | | 1/1999 | Braun | |
| 6,568,088 | B1 | * | 5/2003 | Ende | 30/371 |
| D546,648 | S | * | 7/2007 | Gullicks et al. | D8/20 |

* cited by examiner

*Primary Examiner* — Kenneth E. Peterson
(74) *Attorney, Agent, or Firm* — Morriss O'Bryant Compagni

(57) ABSTRACT

A manually operable cutter device for cutting flexible sheet material, the cutter device comprising a cutter body and a cutting blade assembly operatively mounted to the cutter body and including a rotatable cutter blade having a peripheral edge portion and a fixed cutter blade adapted to cooperate together to provide a cutting zone in which sheet material can be cut. The rotatable cutting blade is mounted for rotation about an axis which extends generally laterally with respect to a normal feed direction of the sheet material to the cutting zone and the direction of rotation of the peripheral edge portion through the cutting zone is in the normal feed direction. The tangential peripheral speed of the rotating cutter blade in the cutting zone is not less than the speed of the feed of sheet material to the cutting zone.teh

1 Claim, 11 Drawing Sheets

CUTTER DEVICE

This invention relates generally to a cutter device suitable for cutting flexible sheet material such as for example paper, cardboard, fabric, plastics and the like.

PRIOR ART

Conventional scissors are tiring to use for extended periods and not ideal for producing smooth, straight cuts, and only produce clean edged tight radius cuts in one direction (to the left in the case of right-handed scissors). There is also some risk of cutting the user, and most scissors can be used as a weapon, resulting in their prohibition in some environments. Scissors may sometimes cut continuously in the hands of skilled users by simply pushing them forward with the blades fixed with respect to each other. This relies on static friction being overcome by starting with a conventional cutting action. However, speed of cut must also be high to keep the friction coefficient low, and the blades must be very sharp. Conventional track type trimmers are safe, quick and easy to use, but the cut length is limited to less than the machine length, and curves are not possible. The machines are bulky, expensive and heavy. Guillotines are capable of heavy cuts, but are heavy, require additional complexity to make them safe and are capable of straight cuts only. Conventional rotary and fixed knife blade cutters are excellent for cutting curves, but are inherently dangerous as the blade must be extremely sharp to cut by pressure alone. They also require a mat to be placed under the paper to prevent marking the surface underneath. It is the object of the present invention to provide an improved cutting device alleviates one or more of the aforementioned disadvantages.

SUMMARY OF THE INVENTION

A cutter device for cutting a flexible sheet material on a work surface, the cutter device including a body with wheels, arranged to stably support the device on the work surface, a cutter disc and a fixed blade with a flat blade section and a cutting edge which meets with the disc to define a cutting zone, wherein: the flat blade section is substantially horizontal and positioned to extend laterally from the cutting zone and adjacent the work surface; and the fixed blade has an associated leading edge portion arranged to slide under and lift the material onto the fixed blade.

In one form the axis of rotation is generally at right angles with respect to the normal feed direction. In another form the axis of rotation is inclined with respect to the normal feed direction. Preferably the tangential peripheral speed of the rotating cutter blade in the cutting zone is greater than the speed of the feed of sheet material to the cutting zone.

The cutter device may include a drive for causing rotation of the rotatable cutter blade. In one form the drive includes a drive wheel which is operatively mounted to the cutter body and adapted to rotate as the cutter body travels over the work surface in a direction opposite to the feed direction. The drive wheel may be operatively coupled to the rotatable cutter blade via a transmission which causes the wheel and the rotatable cutter blade to rotate in the same direction as the cutter body travels over the work surface. The transmission may include a gear train.

The cutter device may further include a guide for the sheet material being fed to the cutting zone. The guide and a leading edge portion of the fixed cutter blade may provide for a slot for receiving the sheet material being fed to the cutting zone. The cutter body may include a frame having support wheels operatively mounted thereto at least one of the ground engaging wheels providing for the drive wheel. Preferably at least one of said support wheels is disposed forwardly of the rotatable cutter blade with respect to the normal direction of travel of the device when cutting.

A guide track may be provided along which the cutter body can travel.

The frame may include a forward end and a rearward end and spaced apart side wall members extending between the forward and rearward end, the support wheels being at the forward end and rearward end and upon which the frame rests at least one of the wheels providing the drive wheel, the rotatable and fixed blades being operatively mounted to one of the side wall members on an outer side portion thereof and disposed between the forward and rearward support wheels. The drive wheel and rotatable cutter blade may be operatively connected at a pivot mount spaced from the drive wheel so that the axis of rotation of the cutter blade can be angularly inclined with respect to the axis of rotation of the drive wheel. The arrangement being such that the drive wheel positively drives the cutter blade.

In one embodiment two cutter blades may be provided each being operatively connected to a respective drive wheel and each having associated therewith a respective fixed cutter blade. The rotatable cutter blades may be operatively connected together by a mechanism arranged such that one drive wheel can rotate at a higher or lower speed relative to the other when the device is changing its direction of travel. The mechanism may for example be in the form of a differential gear train, a series of overrun clutches or the like.

The device may further include a lifter blade which can raise the sheet material off the work surface.

The invention can be easily made inherently safe so that the user is protected from the cutting edges, and there are no long blades to allow stabbing.

Except as otherwise described hereafter, cuts are preferably made with the sheet material flat on a table, with only one hand being required in most cases as the cutter wheels hold the material to be cut steady. The invention may be made in a compact pocket-sized form, or a variety of shapes for various purposes examples of which are described hereafter. A very low manufacturing cost is possible, comparable to basic scissors. There is no power required other than a small pushing force from the operator similar to that required to push a computer mouse. The blades are somewhat self-sharpening as they wear—similar to scissors. The cutting parts are small and can therefore be economically manufactured from wear resistant materials such as ceramics. The invention may be used for straight cuts or curved cuts of either direction, but some embodiments are more suitable to straight cuts and some to curves. Accurate straight cuts and curves of known radii are easily achieved.

The maximum length of freehand straight cuts is limited only by cutting table size. The maximum length of guided straight cuts is limited only by length of the guide track which may be an inexpensive extrusion.

Preferred embodiments of the invention will hereinafter be described with reference to the accompanying drawings and in those drawings.

DESCRIPTION OF PREFERRED EMBODIMENTS

Figure 1:
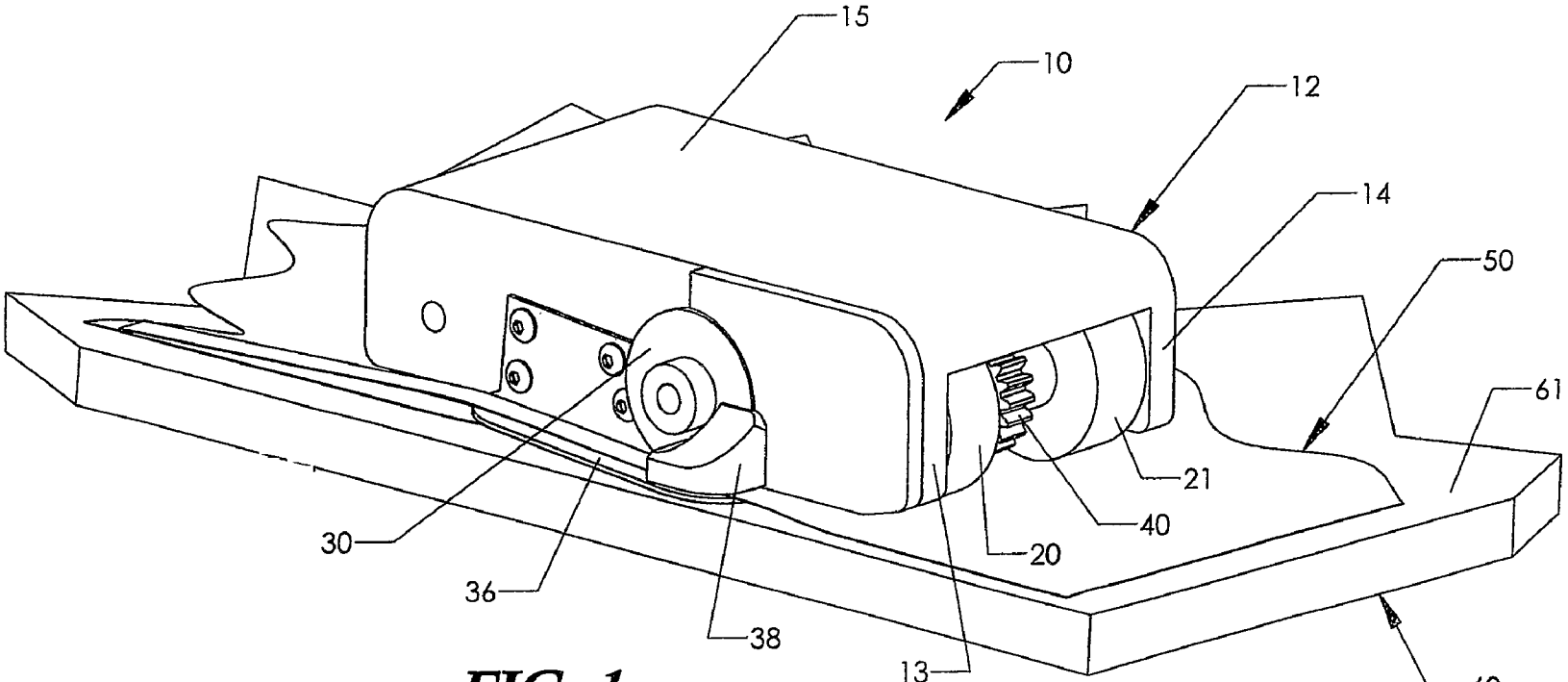
FIG. 1 is a schematic isometric view of a cutter device according to one embodiment positioned on a table and shown cutting a flexible sheet material.
Figure 2:
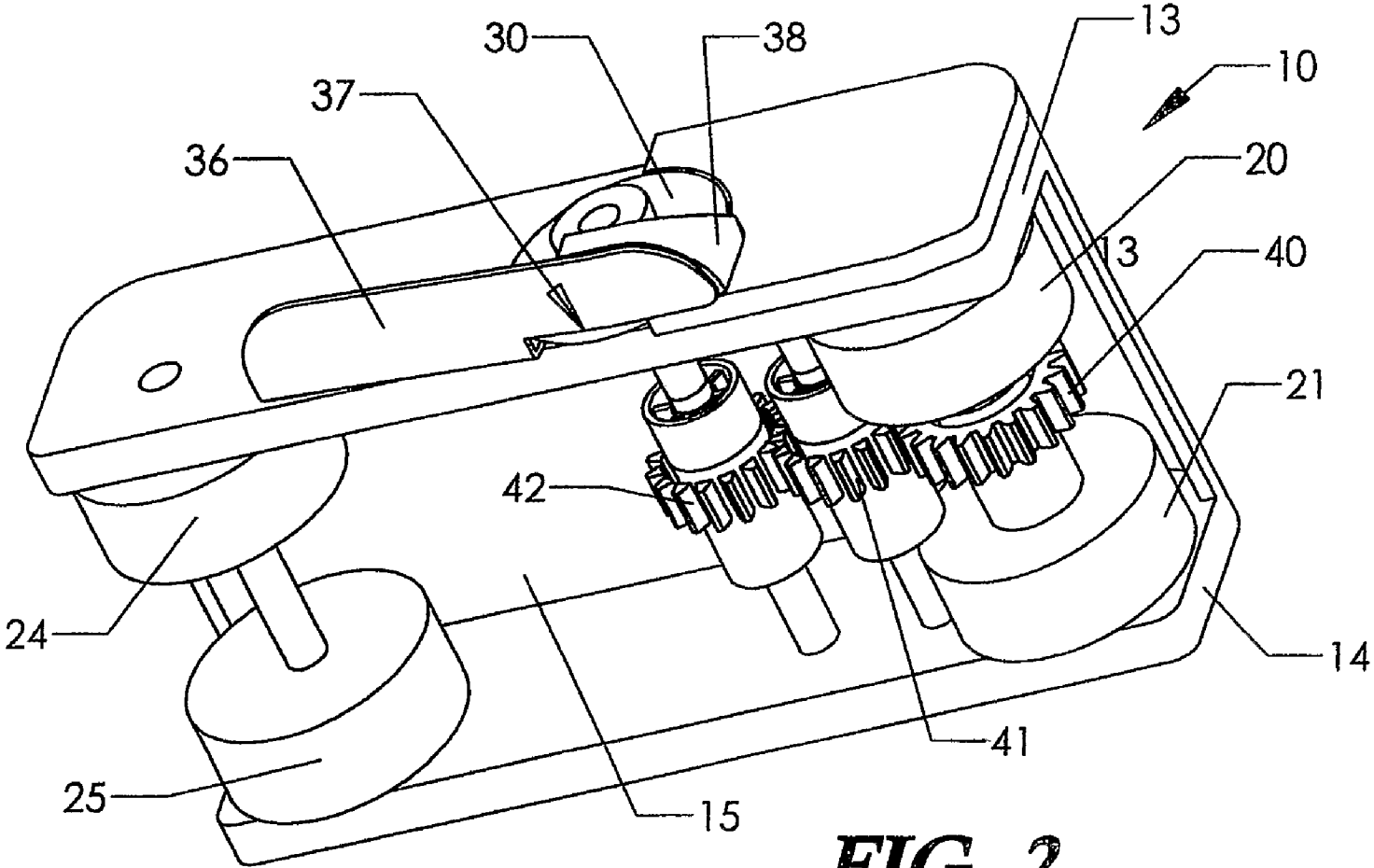
FIG. 2 is a schematic underside view of a cutter device shown in FIG. 1.

Referring to FIGS. 1 to 4 there is shown a cutter device generally indicated at 10 which is particularly suitable for making straight and large radius cuts in flexible materials such as for example paper. The device 10 includes a main body 12 configured to contain the internal parts and to be comfortably held in one hand. The main body 12 includes spaced apart side wall members 13 and 14 and top wall member 15. The device further comprises drive wheels 20 and 21 operatively connected to the main body 12 via one or more substantially horizontal axis bearings 23. The drive wheels 20 and 21 are adapted to roll on the flexible sheet 50 or the work surface 60 on which the material being cut is placed. The work surface 60 in the embodiment shown is in the form of a generally horizontal table 61. As shown in FIG. 2 stabilising wheels 24 and 25 are provided which ensure the cutter device remains planar with respect to the table 61 during use. One or more of the stabilising wheels may also perform as drive wheels, particularly in the straight cutting version of the device.

Figures 3, 4:
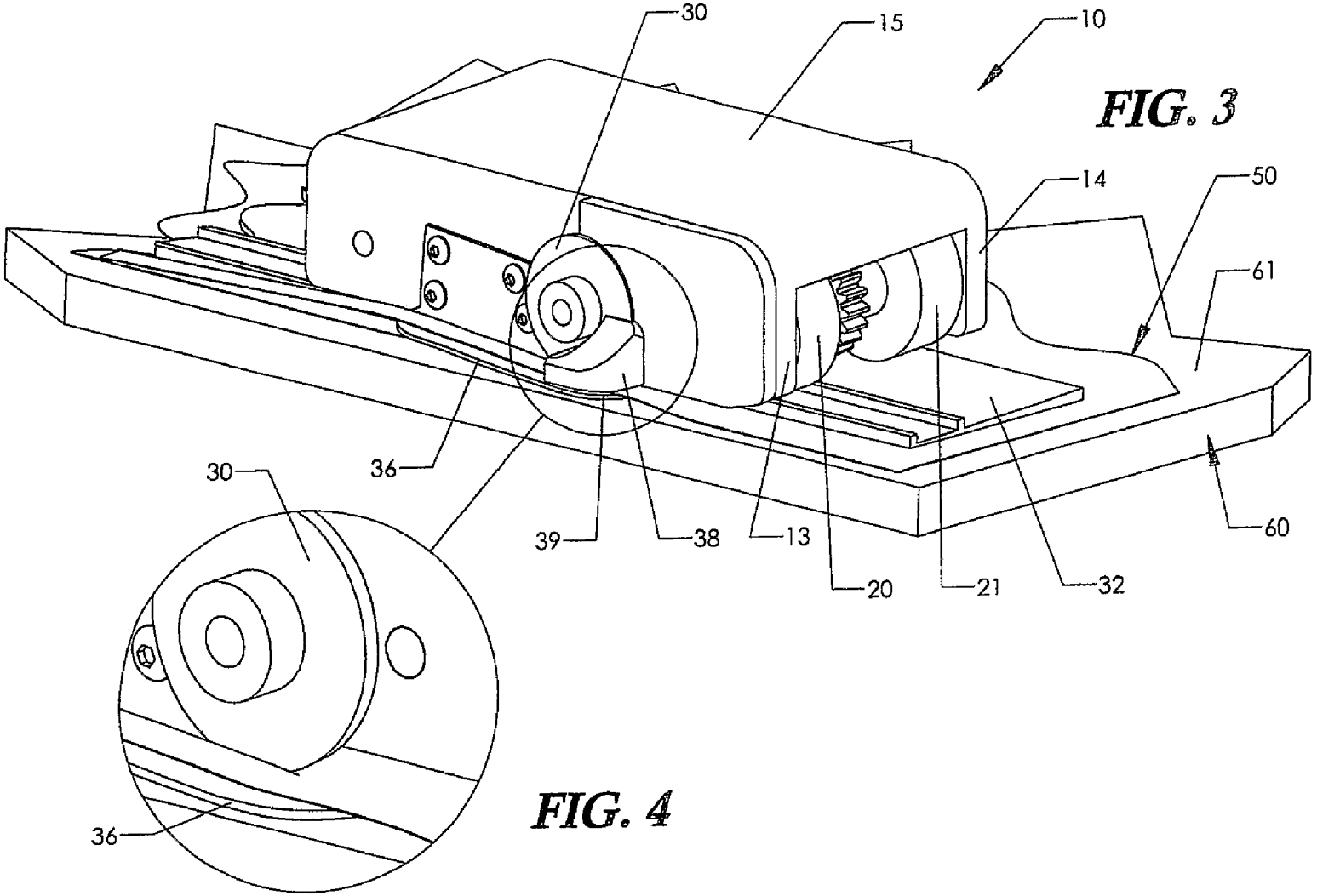
FIG. 3 is a similar view to that shown in FIG. 1 but in use with a guide track.
FIG. 4 is a detail of part of the device shown in FIG. 3 with the guide removed to show the cutting parts.

A rotatable cutter disc 30 is supported by one or more bearings so that its axis of rotation is parallel to, or within approximately 15° of being parallel to the drive wheel axis, with its lower edge close to but not touching the work table 61. Gears 40, 41 and 42 causes the drive wheel to rotate the cutter disc 30, in the same rotational direction as the drive wheel, with a peripheral speed of the cutter disc which is greater than or equal to that of the drive wheel. A fixed blade 36 is mounted to the main body 12 with a cutting edge 37 substantially horizontal or tilted down slightly in the forward direction as shown and positioned close to the cutting table and against the cutting edge of the cutter disc 30. As best seen in FIG. 3, guide 38 is provided which together with the body or the fixed blade forms a narrow entry slot 39 leading to the region where the cutter disc and fixed blade first meet. As shown in FIG. 3 a guide track 32 on which the cutter may run may be provided to assist in producing straighter cuts. The guide track 32 includes a channel or groove 33 in which drive wheel 20 for example can be positioned. An optional graduated visual guide, not shown, attached to the cutter anywhere ahead of or in the entry slot, close to the paper surface which may be used to align the cut with lines on the paper.

Figure 19:
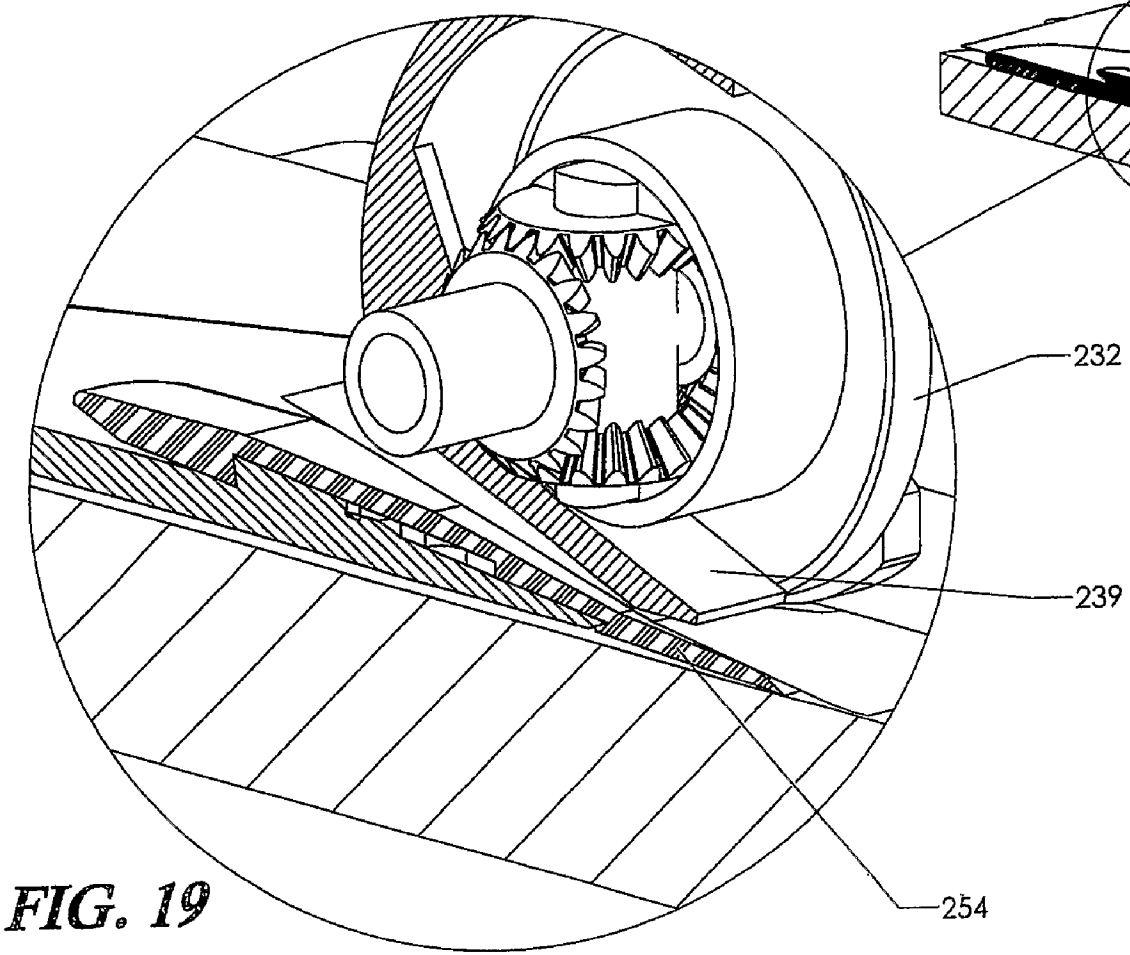
FIG. 19 is a detail of part of the device shown in FIG. 18.
Figure 20:
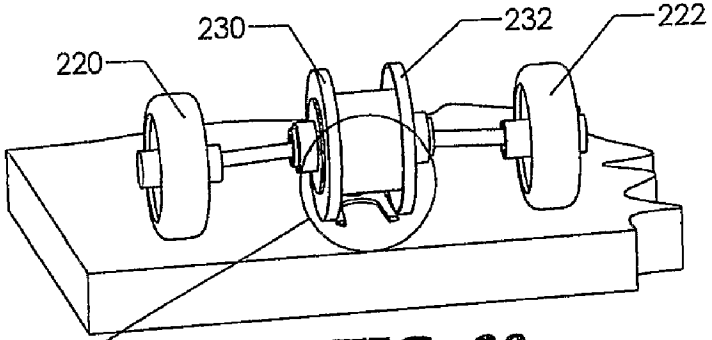
FIG. 20 is a schematic view of some of the components of the device shown in FIGS. 13 to 19.
Figure 21:
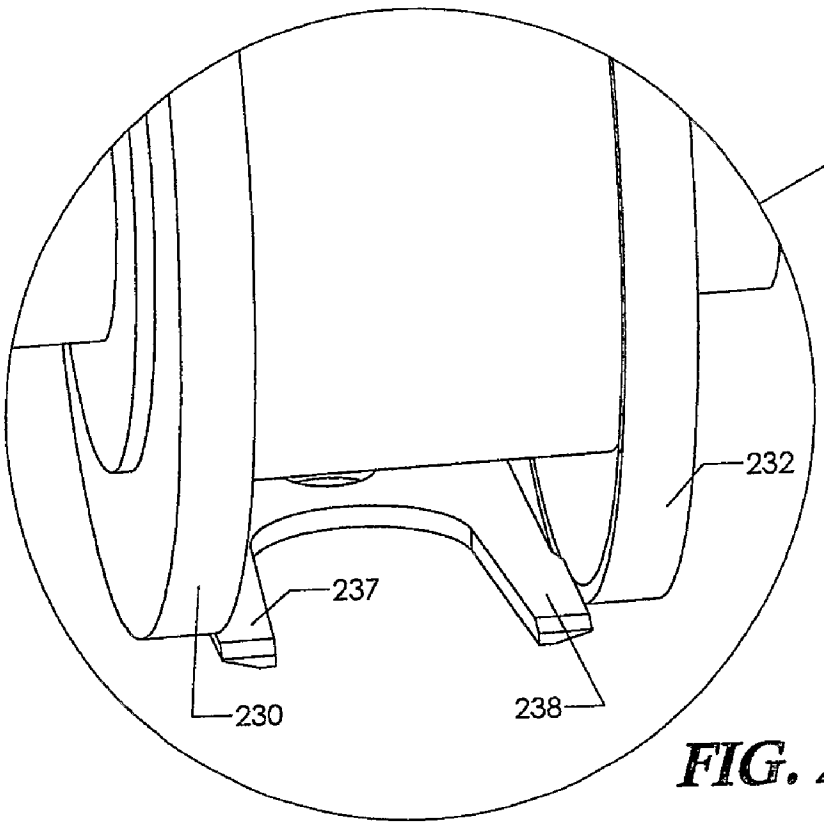
FIG. 21 is a detail of part of the device shown in FIG. 20.

The operation of the device is hereinafter described. The cutter body 12 is presented to the edge of the material 50 being cut and the material lifted by hand if required or by a lifter such as for example flexible blade 254 as shown in FIG. 19 so that the fixed blade 36 passes under it. The cutter is then pushed further with a slight downward force to provide traction for the drive wheels. The gears 40, 41 and 42 drive the cutter disc 30 at a peripheral speed equal to or greater than the forward speed of the cutter body but in the opposite direction (the same rotational direction as the drive wheel). The cutting disc 30 thus slides backwards against the material 50, tending to draw the material into the cutting blades at the point of shear.

Preferably, the cutting edges of the cutter disc and the fixed blade are held in contact by a spring element (not shown). The spring element may be a separate item or built into the cutter disc or fixed blade in the form of structural flexibility. An external button or other means of separating the cutting parts may be provided to clear torn material caught between the cutting parts, if required.

The sheet material passes through the narrow entry slot 39 above the fixed blade 36 to prevent the paper buckling under compression. This compression force, combined with the traction force of the cutter disc drives the sheet material through the cutter. FIG. 4 illustrates the shearing action with the guide removed for clarity. The sheet material continues to be cut while the cutter is pushed forward and the drive wheel turns.

To improve the straightness of cut, a guide track 32 as shown in FIG. 3 may be placed on the sheet material and under the cutter so that the cutting blades run to one side of the track, over the sheet material, and the drive wheel and the following stabilizing wheel is guided by and runs in a groove 33 formed in the track. The cutter may be totally separate from the guide track as shown, or captive (not shown) so that it is free to move between the ends but may not be removed. It may also be semi-captive whereby a spring-loaded latch or sliding lock or other mechanical device preventing the cutter coming free from the track unless required by the user. Captive or semi-captive configurations make ideal replacements for expensive track type rotary trimmers.

The device operates because the sum of the paper driving forces exceeds the sheet material stalling forces. The sheet material driving forces are the sum of the cutter disc traction force and the sheet material compression force. The sheet material stalling force is the sum of the fixed blade sliding friction (with respect to the sheet material) and the component of the shearing force parallel to the travel direction of the sheet material. Preferably, operation is achieved by maximising the driving and minimising the stalling forces as follows. Minimising the cutter disc slip velocity maximises the coefficient of friction (which is lower at higher sliding velocities in most cases—hence the need for antilock braking stems in motor vehicles). The cutter disc friction can be maximised through material selection of the substantially cylindrical surface next to the cutting edge. The drive wheel to sheet material friction can be maximised through material selection and placement of non-driving wheels and skid pads as far as possible from the point of application of the user's drive force. The sheet material entry slot gap is minimised, to reduce drag from sheet material buckling under compression. The static and dynamic coefficients of friction of the fixed blade material surface may be minimised as is the angle between the cutter disc and fixed blade at the region of shear, thereby minimising the component of the shearing force parallel to the sheet material travel direction. The friction coefficient of the lower surface of the sheet material with respect to the upper surface can be minimised by inverting the sheet material if necessary.

A cutter with two or more non-coaxial wheels on fixed axles will tend to cut in a straight line although elastomeric tyres will allow large radius to be cut if a turning torque about the vertical axis is applied while cutting. Tighter radii require that the cutter may be steered easily by use of a steering wheel or other control device, or by turning the cutter directly if it has caster wheel or skid pad to support it. A steerable caster wheel may be provided to offer the user a choice of both types of control; that is, the caster wheel may be steered directly or the whole cutter turned while the caster wheel follows passively. In all cases any wheel coaxial with the drive wheel must be free-spinning, and supports away from the drive wheel axis must be slide pads or caster wheels to allow the cutter to turn easily. This is only part of the solution however.

During turning, the drive wheel must be in firm contact with the sheet material to achieve traction and the sheet material is constrained laterally by the cutting blades. The shearing region must therefore be directly under the drive wheel bearing axis so that the distance between the traction and shearing points can remain constant without distorting the sheet material. The first embodiment described above does not achieve this.

The cutting disc and fixed blade also constrain cutter steering. As with conventional scissors, the sheet material must pass the cutter surfaces after being sheared, and if these are straight the sheet material may only be turned in one direction without distortion of the side of the sheet material being retained—assuming the other side is scrap. For right-handed scissors for example, left turns produce an undistorted edge only to the left of the cut. It is impossible to produce undistorted left and right turn cuts on the same piece of sheet material with scissors; the effect is particularly noticeable with thick material such as cardboard. This effect is difficult to avoid with scissors as the shear region must move along the blades, which must therefore be straight to produce a straight cut by default. The shearing region of the proposed invention is very short however, which allows more directional flexibility.

The surface speed ratio between the drive wheel and cutter disc may be modified for versions able to cut curves due to the lateral distance between the drive wheel and cutter. As the cutter slides on the sheet material in the opposite direction to the direction of cut, the gearing compensates for the drive wheel running on a smaller radius if it closer to the radius centre than the cutter.

Figure 7:
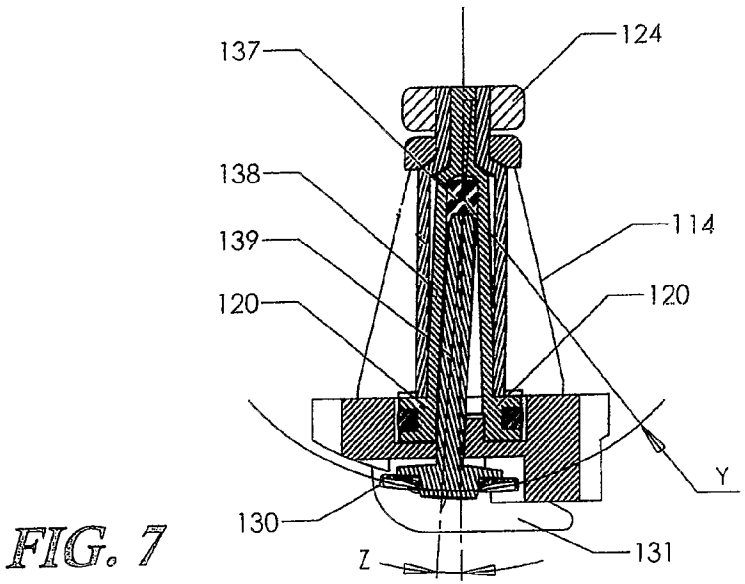
FIG. 7 is a plan section A-A view of the embodiment shown in FIGS. 5 and 6, from above, at the axis of the drive wheel.
Figure 8:
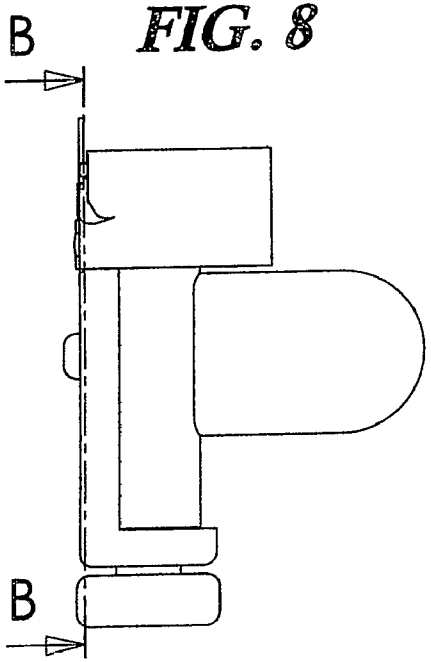
FIG. 8 is a front elevation of the embodiment shown in FIGS. 5 to 7 illustrating the position of the section plane as illustrated in FIG. 9.

A second embodiment of cutter device is shown in FIGS. 5-12. The cutter device generally indicated at 110 comprises a cutter body 112 which includes a cutter housing 113 and an arm 114 extending from the housing. As best seen in FIG. 7 the device further includes a drive wheel 120 and a cutter disc 130 operatively connected to the drive wheel 120 through a coupling assembly which includes a flexible coupling element 137 and axle 138. Axle 138 and drive wheel 120 have a hollow therein so that the cutter disc shaft 139 can extend therethrough. The arrangement is such that there is a positive drive between the drive wheel 120 and the rotatable cutter disc 130. The device further includes a handle 116 having a guide wheel 127 at its free end. A stabilising wheel 124 is provided at the free end of arm 114. The handle 116 is adapted to be tilted upwardly without tilting housing 113. A fixed cutter blade 131 is mounted to the housing adjacent the cutter disc 130.

Figure 5:
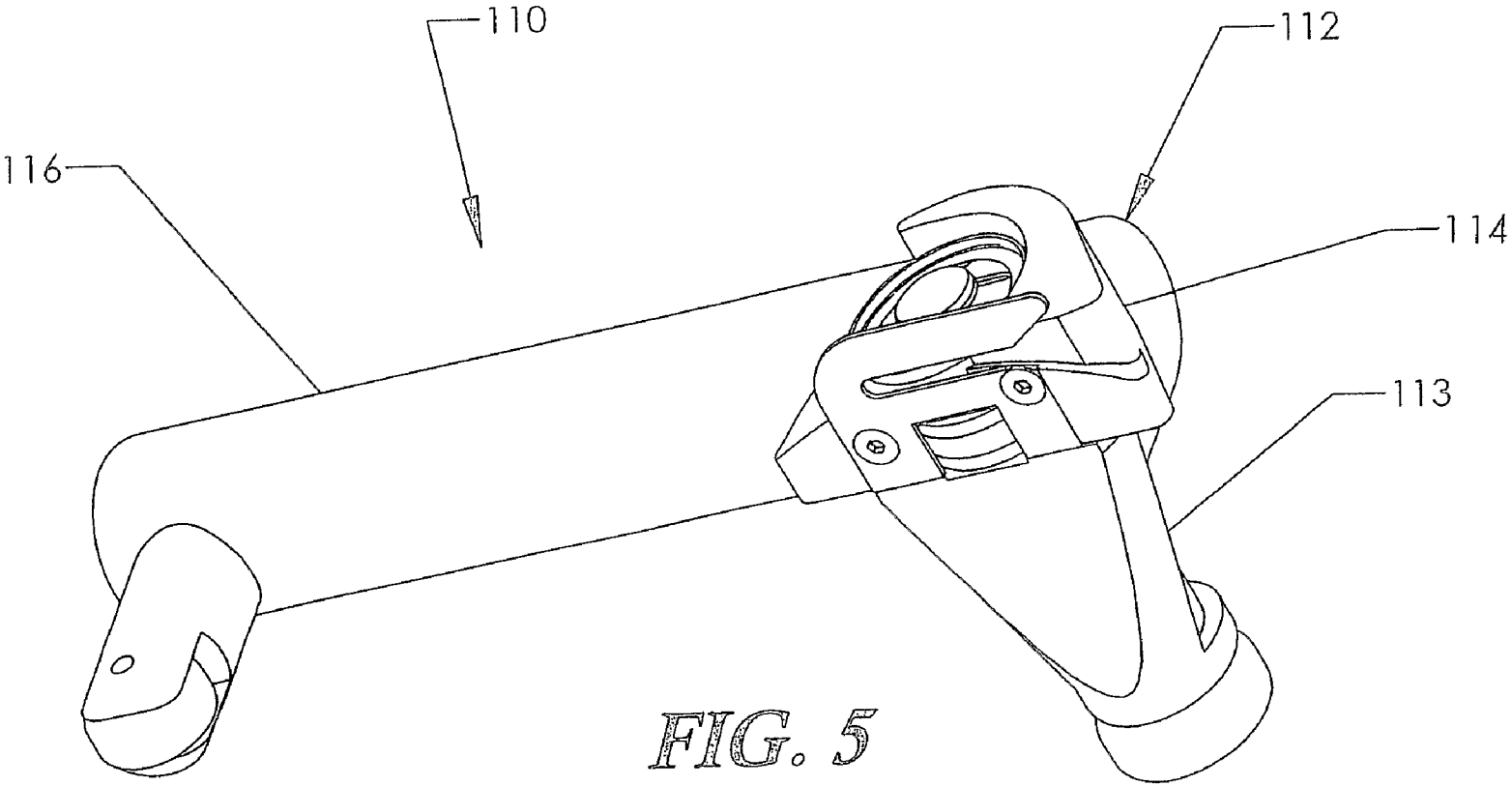
FIG. 5 is a schematic underside view of a second embodiment of the cutter device according to the invention.
Figure 6:
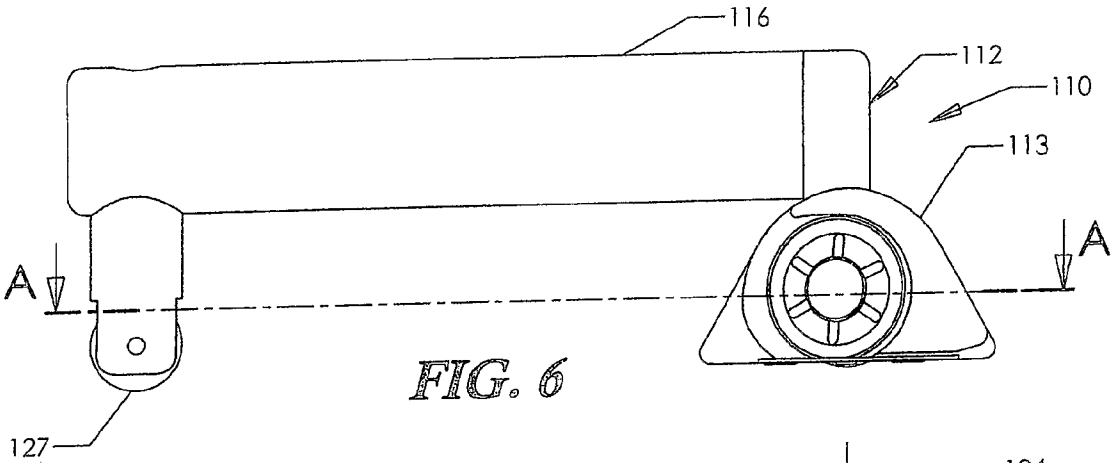
FIG. 6 is a side elevation of the embodiment shown in FIG. 5 from the side of the cutting parts.

In this embodiment the cutter disc 130 has a larger diameter than the drive wheel 120 and is driven directly via an angled shaft 139 and flexible coupling 137 connected to the hollow drive wheel axle 138, as shown in FIG. 5. (In an alternative embodiment, the cutter disc is smaller than the drive wheel and driven via an internal gear attached to the drive wheel and a pinion on the cutter driveshaft.) In both cases the cutter disc peripheral speed is greater than that of the drive wheel and in the same rotational direction. The wheel to cutter surface speed ratio is increased beyond that required for straight cutting to compensate for the drive wheel peripheral speed being slower than the cut speed at the cut region when cutting a curve that places the drive wheel closer to the curve centre point than the cutter. This ratio limits the minimum cut radius: radii below this will stall the cutter. The cutter disc axis lies behind the drive wheel axis at the cutting surface and may be or angled to it as shown at Z in FIG. 7 (or parallel, if gear not shown). The point of shear is as close as possible to directly under the wheel axis so that the "shear point lead" X (FIG. 9) is as small as possible to minimise cut edge damage in tight radii.

Figure 9:
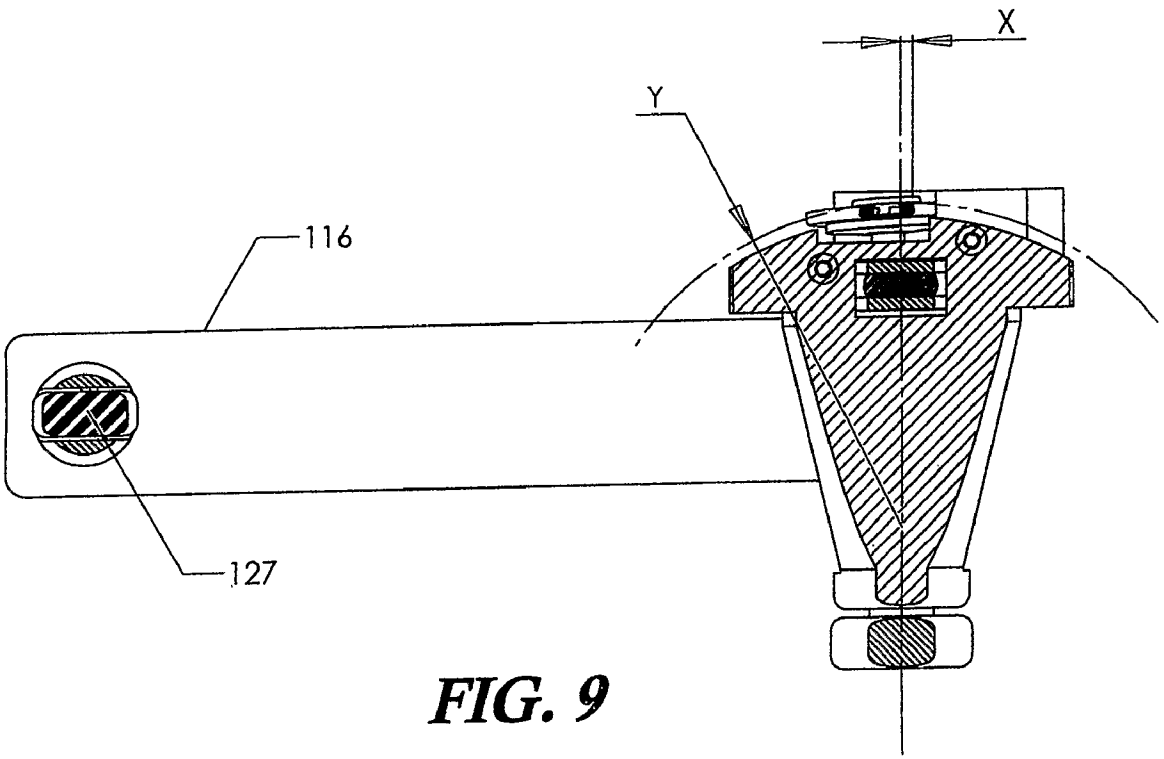
FIG. 9 is a plan section B-B view of the embodiment shown in FIGS. 5 to 8, from below, at the plane of the paper where it is cut.
Figure 11:
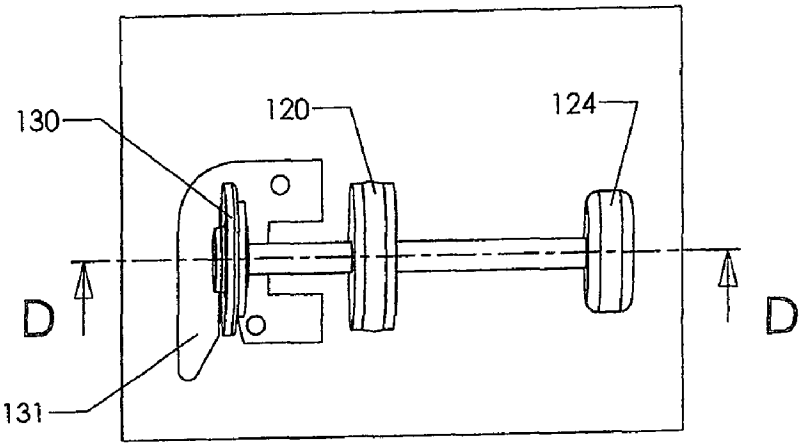
FIG. 11 is a plan view of those components shown in FIG. 10.
Figure 12:
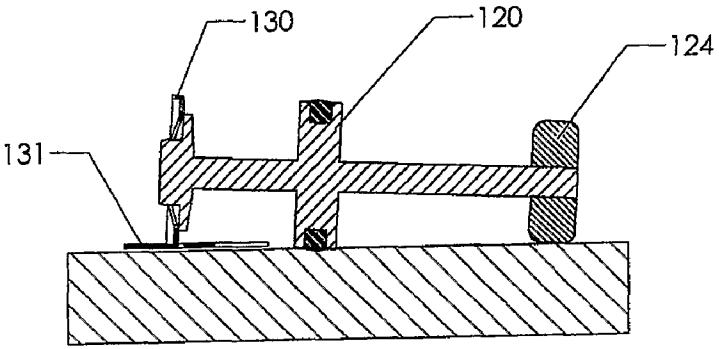
FIG. 12 is a sectional view taken along the line D-D in FIG. 11.
Figure 10:
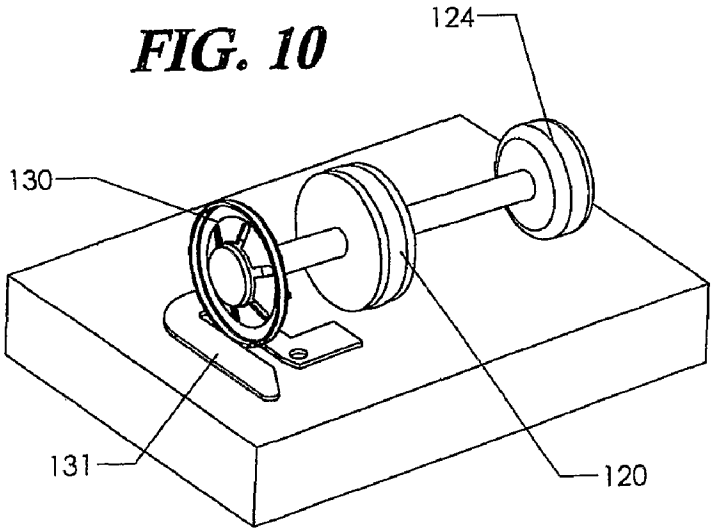
FIG. 10 is a schematic layout of some of the components of the device shown in FIGS. 5 to 9.
Figure 13:
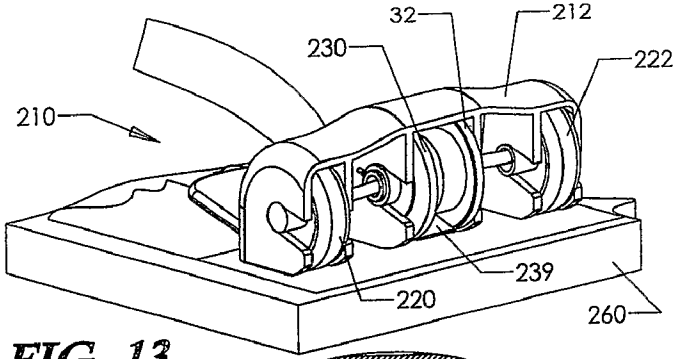
FIG. 13 is a schematic isometric view of a third embodiment of cutter device of the invention.
Figure 14:
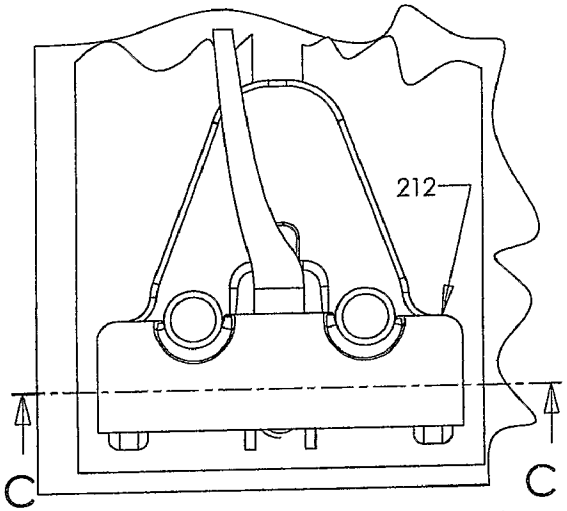
FIG. 14 is a plan view of the device shown in FIG. 13.
Figure 15:
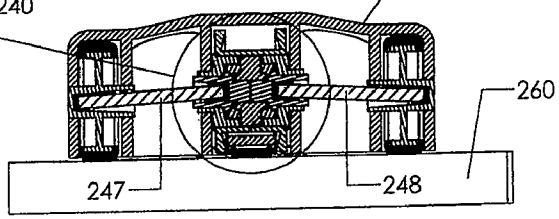
FIG. 15 is a sectional view taken along the line C-C in FIG. 14.
Figure 16:
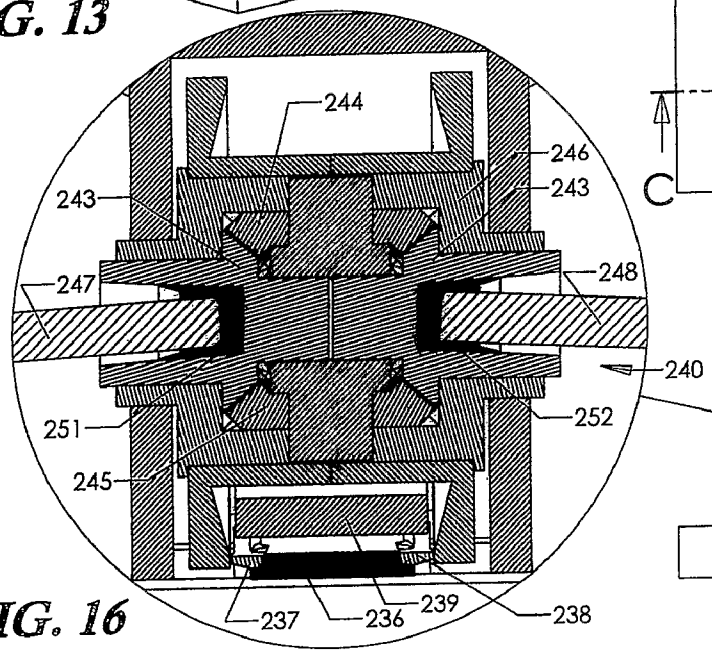
FIG. 16 is a detail of part of the device shown in FIG. 15.
Figure 17:
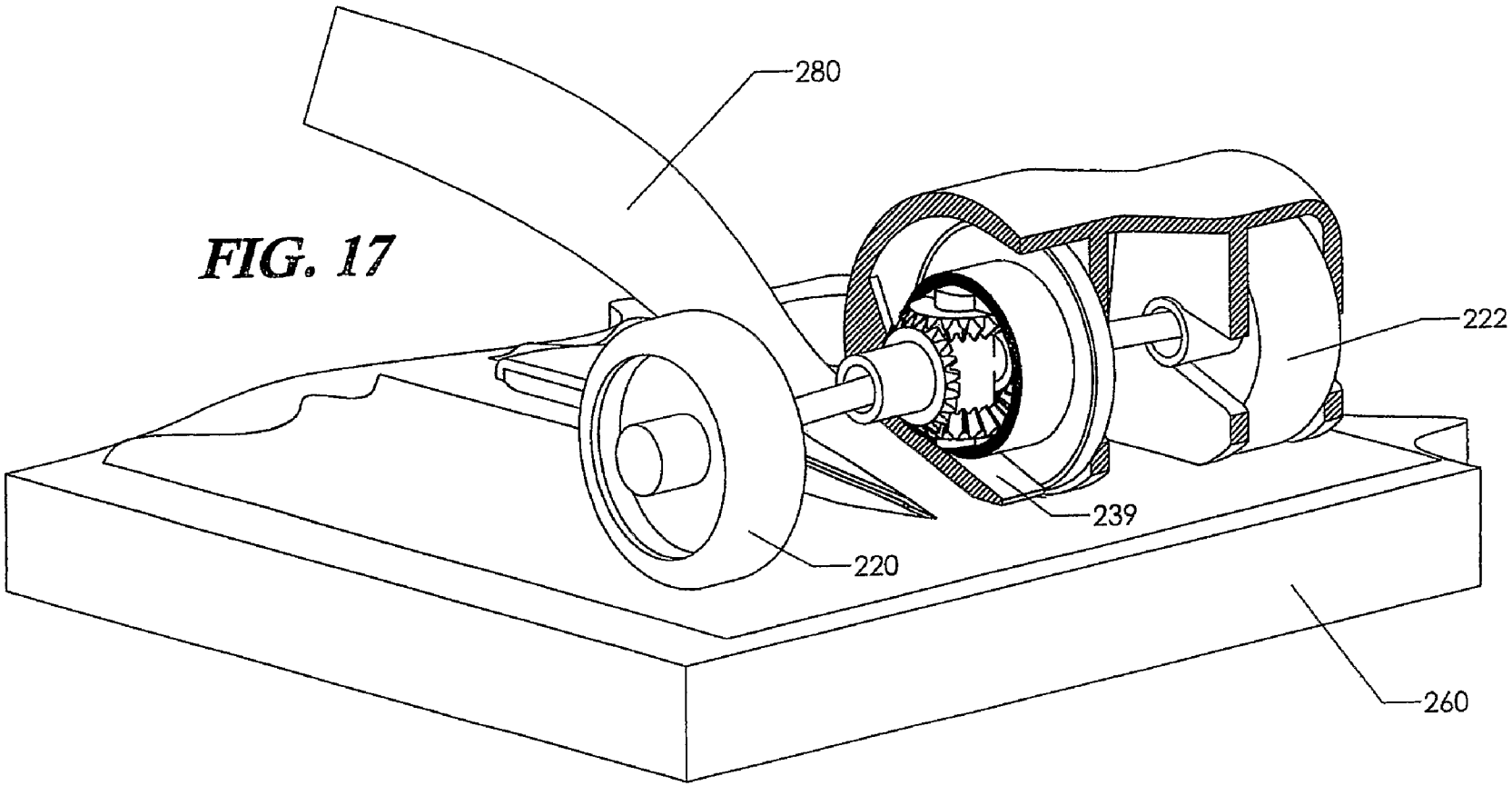
FIG. 17 is a partially cutaway isometric view of the third embodiment.
Figure 18:
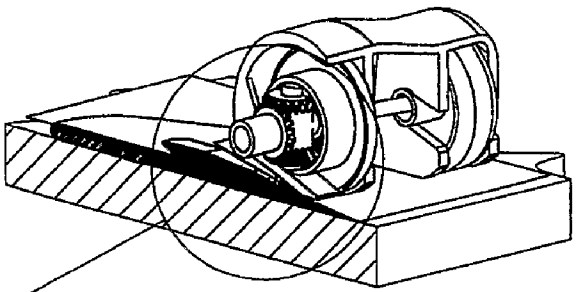
FIG. 18 is a partial sectional view of the third embodiment.

The cutter disc 130 may have a convex conical, spherical or otherwise curved shearing face to present a substantially straight shearing region which is substantially parallel to the direction of travel and cut. This also reduces the radius presented to the cut sheet material, so that curves above this radius can be cut without distortion of the sheet material edge. FIG. 9, a section through the plane of the paper shows the minimum cut radius Y possible while avoiding contact between the sheet material edge and the non-cutting parts of the cutter disc, as well as the body. The cutter disc 130 may have a raised section contacting the fixed blade 131 so that the disc edge is sharpened by moving contact. The fixed blade 131 may have a wear-resistant insert as the contact area is very much smaller than that of the disc. The guide wheel 127 can be engaged with the sheet material as required to produce a straight cut or constant radius curve and a castor wheel, not shown, may be added ahead of the drive wheel to hold the sheet material down while it becomes engaged at the start of the cut. The guide wheel 127 mount attached to the operating handle may be rotated about the vertical axis, with a calibrated scale (not shown) and locked for a constant cut radius or free and constantly steered. The operating handle is attached to the handle horizontal pivot allowing the user to lift the guide wheel without disturbing the cutting action.

A further embodiment of the cutter device is shown in FIGS. 13-21. This embodiment is particularly suited for cutting tight radius curves.

Referring to the drawings the cutter device 210 comprises a main body 212 which houses two cutter discs 230 and 232. Each disc 230 and 232 has a fixed blade 236 with cutting edges 237 and 238. The device further includes two drive wheels 220 and 222 operatively connected to respective cutter discs 230 and 232.

The main body may be substantially symmetrical about the vertical plane perpendicular to the drive wheel axis. The two cutter discs 230 and 232 may be separable or manufactured as one piece, which straddle the fixed blade 236 so that two cuts are made simultaneously and a narrow strip of waste material 280 is usually generated. The resulting device is effectively two mirror image medium radius cutters, as described above, joined together. As with the other embodiments described, the cutter peripheral speed is greater than or equal to that of the drive wheel and in the same rotational direction. In this embodiment the two drive wheels are of a smaller diameter than the cutter discs, and drive the with no rotational speed increase over the average speed of the two wheels. A differential gearbox 240 allows one drive wheel to rotate at a higher speed and one at a lower speed than the discs during turning.

The differential gearbox 240 comprises two crown wheels 242 and 243, two planet gears 244 and 245 and a multi-part planet wheel cage 246 which is fixed to and mounted inside the cutter device. Each drive wheel drives a crown wheel via a drive shaft 247 and 248, each of which has a flexible coupling 251 and 252 at each end. The cutter discs therefore have a peripheral speed equal to the average peripheral speed of the drive wheels tines the ratio of the cutter to wheel diameters, chosen to ensure the traction force on the paper is in the correct direction at all times, irrespective of the turn radius. This embodiment minimises the cutter disc to paper slip velocity under straight cutting conditions, increasing the desirable traction friction.

The cutter disc axis is preferably placed behind the drive wheel axis at the cutting surface and may be parallel or angled to it; preferably the latter so that the shearing region is as close as possible to directly under the wheel axis. FIGS. 13-19 show the two axes in the same plane for the sake of clarity. The cutter discs may have a convex conical, spherical or otherwise curved shearing faces to produce a substantially straight shearing region which is substantially parallel to the direction of travel and cut. However, this has little effect on the minimum radius that can be cut without distortion of the paper edge as only the central waste strip has its path impeded. The left and right cut parts of the paper are substantially unimpeded laterally by the cutter discs as they pass underneath. The fixed blade is made as thin as possible with a relief angle below the shear region so that the left and right cut parts are almost completely unimpeded while turning.

This embodiment has a sheet material lifter 254 which has a sharp leading edge and stays in contact with the work table 260 so as to slide under the paper and lift it onto the fixed blade. The lifter is removable, and located between the tines of the fixed blade in case of the need for replacement by the user. The tines in this embodiment are slightly flexible and preloaded together to provide the force needed to keep the cutting edges in contact at the point of shear.

Further preferred embodiments of the cutter (not shown in the figures) may be derived from any of the above embodiments for use with stiffer grades of sheet material. The cutter would be fixed in a convenient orientation to the user, the work table being effectively replaced by a small moveable table on which the sheet material is held by the user or by other mechanical means. In these embodiments the table and sheet material are held by the operator and drawn through the cutter. These embodiments provide the user a better ergonomic position for fine, close work, and position the cutting region in a constant orientation.

Further preferred embodiments of the cutter (not shown in the figures) may be derived from all of the above embodiments but with the moveable table being replaced by one or more rollers loaded by springs, or other means, against the drive and stabilising wheels, if any are present, separated by and locating the sheet material. In these embodiments the paper is held by the operator and drawn directly through the cutter.

In a further preferred embodiment of the cutter shown may be derived from any of the above embodiments for by eliminating transmission elements such as gears, belts and flexible couplings altogether. The cutter disc is mounted on the same shaft, or mechanical equivalent, as the driving wheel, which is of a smaller diameter to achieve the higher surface speed required, as described above. Other items shown in the figures are numbered as for the other embodiments, that is; the stabilising wheel, the table and the point of shear.

To operate on a flat surface, the drive wheel axis is mounted tilted within the body so the cutter disc clears the table, but otherwise the cutter is similar to the embodiments described above. The direct drive particularly lends itself to a captive track mounted configuration. In such an embodiment the track thickness allows the drive wheel diameter to be less than that of the cutter disc while the drive wheel axis is substantially horizontal.

In a further preferred embodiment of the track mounted cutter (not shown in the figures) comprise a gear rack formed in the track which engage with a gear attached to the drive wheel to ensure wheel and therefore cutter rotation with reduced downward force required. The rack and pinion may be replaced by other positive drive means; a tensioned cord or belt attached at one end of the track, wrapping around the drive wheel or shaft, then continuing to an attachment at the other end of the track, for example.

Preferably in embodiments able to operate either with or without a track, the gear outer diameter is less than the wheel diameter to prevent contact with the table.

Features described above may be transferred freely between the above embodiments to produce numerous variations. For example, the handle described in the medium radius embodiment may be used in the tight radius embodiment, and the paper lifter would be useful in all embodiments.

Any number of the items shown as stabilizing wheels may be used as drive wheels by being connected the cutter disc via a suitable transmission.

The transmission may be by belt, traction between conical or cylindrical components, or, as described above, by gear, direct coaxial drive or flexible coupling.

Throughout this specification, unless the context requires otherwise, the word "comprise", and variations such as "comprises" or "comprising", will be understood to imply the inclusion of a stated integer or step or group of integers or steps but not the exclusion of any other integer or step or group of integers or steps.

The reference to any prior art in this specification is not, and should not be taken as, an acknowledgement or any form of suggestion that that prior art forms part of the common knowledge in Australia.

Whilst the present invention has been hereinbefore described with reference to particular embodiments, it will be understood that numerous variations and modifications will be envisaged by persons skilled in the art. All such variations and modifications should be considered to fall within the scope of the invention as broadly hereinbefore described.

The invention claimed is:

1. A cutter device for cutting a flexible sheet material on a work surface, the cutter device comprising:

a cutter body of generally rectangular shape; a cutter disc operatively mounted to the cutter body, the cutter disc comprising a rotatable cutter disc having a peripheral edge portion;

a fixed blade connected to the cutter body and having a flat blade section oriented horizontally to the cutter disc, the fixed blade having a cutting edge which is positioned adjacent to the peripheral edge portion of the cutter disc to define a cutting zone for effecting the cutting of material between the cutting edge of the fixed blade and the peripheral edge portion of the cutter disc, and having a leading edge portion arranged to slide under and lift material onto the fixed blade;

a guide slot, located above the fixed blade and forwardly of the cutting zone, the guide slot being positioned to feed sheet material to the cutting zone;

a plurality of wheels operatively connected to the cutter body, the plurality of wheels comprising four wheels that are positioned within an outer perimeter of the cutter body, two wheels being positioned at a rear portion of the cutter body and two wheels being positioned at a front portion of the cutter body to provide stability to the cutter body, the cutter disc and fixed blade being positioned between the wheels positioned at the front portion of the cutter body and the wheels positioned at the rear portion of the cutter body, the cutter disc and fixed blade being laterally offset to one side of all four wheels, the fixed blade cutting edge being substantially parallel to a plane defined by the four bottom points of the four wheels;

wherein the cutter disc is geared to one of the wheels in a manner to cause the cutter disc to rotate faster than a forward speed of the cutter body over a material to be cut.

* * * * *